US006558077B1

(12) United States Patent
Colson

(10) Patent No.: US 6,558,077 B1
(45) Date of Patent: May 6, 2003

(54) SELECTIVE SUSPENSION DRAIN CLOSURE APPARATUS

(76) Inventor: Cameron M. Colson, 656 E. Taylor Ave., #2, Sunnyvale, CA (US) 94086

( * ) Notice: Subject to any disclaimer, the term of this patent is extended or adjusted under 35 U.S.C. 154(b) by 0 days.

(21) Appl. No.: 09/811,034

(22) Filed: Mar. 16, 2001

(51) Int. Cl.[7] ..... E02B 13/00; B65D 90/24

(52) U.S. Cl. ..... 405/36; 405/52; 405/129.57; 405/129.85; 137/312; 588/259; 210/170; 210/533; 210/747; 404/2

(58) Field of Search ..... 405/36, 37, 41, 405/52, 59, 128.1, 128.5, 128.75, 129.45, 129.5, 129.55, 129.57, 129.85; 137/312, 313, 314, 363; 588/249, 259, 260; 141/86; 210/163, 164, 169, 170, 533, 747; 404/2–5

(56) References Cited

U.S. PATENT DOCUMENTS

| | | | | | |
|---|---|---|---|---|---|
| 1,195,827 | A | | 8/1916 | Lucke | |
| 1,900,658 | A | | 3/1933 | Niedecken | |
| 2,097,044 | A | | 10/1937 | Riddle | 210/164 |
| 2,246,390 | A | | 6/1941 | Smith | 210/164 X |
| 2,504,474 | A | | 4/1950 | Van Oss | 210/163 X |
| 2,783,852 | A | | 3/1957 | Sisk | 210/165 |
| 3,306,448 | A | * | 2/1967 | Baker | 210/169 X |
| 3,349,917 | A | | 10/1967 | Strickland | 210/164 |
| 3,628,664 | A | * | 12/1971 | Stanwood | 210/169 |
| 4,136,010 | A | | 1/1979 | Pilie et al. | 210/164 |
| 4,173,858 | A | * | 11/1979 | Cassia | 141/330 X |
| 4,348,279 | A | | 9/1982 | Tikhonov et al. | 210/96.1 |
| 4,419,232 | A | | 12/1983 | Arntyr et al. | 210/164 |
| 4,593,714 | A | * | 6/1986 | Madden | 137/314 X |
| 4,621,939 | A | | 11/1986 | Thomann et al. | 404/4 |
| 4,650,365 | A | | 3/1987 | Runnels | 404/25 |
| 4,659,251 | A | * | 4/1987 | Petter et al. | 405/52 |
| 4,696,330 | A | * | 9/1987 | Raudman et al. | 141/86 |
| 4,770,317 | A | * | 9/1988 | Podgers et al. | 141/86 X |
| 4,793,387 | A | * | 12/1988 | LeBlanc et al. | 141/86 |
| 4,971,477 | A | | 11/1990 | Webb et al. | 405/154 |
| 4,986,907 | A | | 1/1991 | Uzeta | 210/179 |
| 5,092,251 | A | | 3/1992 | Hamaker et al. | 108/51.1 |
| 5,117,877 | A | | 6/1992 | Sharp | 141/86 |
| 5,222,832 | A | | 6/1993 | Sunderhaus et al. | 405/52 |
| 5,236,595 | A | * | 8/1993 | Wang et al. | 210/669 |
| 5,383,745 | A | | 1/1995 | Shannon | 405/52 |
| 5,569,372 | A | * | 10/1996 | Smith | 210/164 X |
| 5,582,720 | A | | 12/1996 | Deming | 210/164 |
| 5,728,294 | A | | 3/1998 | Deming | 210/164 |
| 6,295,661 | B1 | * | 10/2001 | Bromley | 137/362 X |
| 6,339,952 | B1 | * | 1/2002 | Potter et al. | 73/40 |

FOREIGN PATENT DOCUMENTS

| | | | |
|---|---|---|---|
| CA | 555868 | 4/1998 | 210/163 |
| FR | 2673654 | 9/1992 | 29/14 |
| WO | 97/38776 | * 10/1997 | |

OTHER PUBLICATIONS

Betty Rushton "Infiltration Opportunities in –Parking–Lot Designs Reduce Runoff and Pollution," Stormwater, Buyers Guide 2003, 11 pgs.

(List continued on next page.)

*Primary Examiner*—Jong-Suk Lee
(74) *Attorney, Agent, or Firm*—Haverstock & Owens LLP

(57) ABSTRACT

An apparatus for controlling a flow of a liquid into a sewer drain comprising a catch basin having a catch basin drain coupled with the sewer drain. In addition, a housing element that is positioned within the catch basin, whereby the housing element is coupled with the catch basin drain in a first fluid-tight manner. The housing element having a porous surface positioned below a predetermined level. A column having a proximal end and a distal end, whereby the column is positioned within the housing element and the proximal end is coupled with the catch basin drain in a second fluid tight manner. The distal end is positioned above the predetermined level and an actuator mechanism is coupled with the column and configured to selectively open and close the column to the flow of the liquid that is entering the catch basin drain.

27 Claims, 6 Drawing Sheets

OTHER PUBLICATIONS

FOSS Environmental "Industrial Product Guide," FOSS Environmental Industrial Product Guide, Winter 1999.

Kayhanian, et al., "CALTRANS Storm Water Management Program," Mar./Apr. 2001, pp. 52–76, Stormwater.

Hydro Compliance Management, Inc., "Hydro–Kleen Filtration System (Installation and Maintenance)," Hydro Compliance Management, Inc. Webpage undated.

Enders, Steve, "A Saratogan Living Life in the Sewer to Save the Bay," May 5, 1999, Saratoga News Webpage (www.metroactive.com/papers/saratoga.news/05.05.99/drain–9918.html).

Remedial Solutions, Inc., "Aqua Shield," Remedial Solutions, Inc. Webpage (www.remedial.solutions.com/aqua—shield/cf–200–specs.html). undated.

Storm King, "Storm King Dynamic Separator," Storm King Webpage undated..

Knight Treatment Systems, Inc., "Fossil Filter," Knight Treatment Systems Webpage (www.knighttreatmentsystems.com/kn02000.htm) undated.

United States Government, Code of Federal Regulations "Sec. 122 EPA Administered Permit Programs: The National Pollutant Discharge Elimination System," Title 40, vol. 13, Parts 87 to 135 48 FR 14153, Apr. 1, 1983; 50 FR 6940, Feb. 19, 1985.

Stormceptor, "Stormceptor Stormwater Quality Treatment Device," Stormceptor Webpage undated.

CDS Technologies, "Best Management Practice for Treatment of Stormwater Runoff from Parking Lots, Vehicle Service and Storage Facilities," CDS Technologies Informational Sales Brochure undated.

Dandy Products, Inc., "Innovative Technologies for Today's Construction Industry," Dandy Products, Inc. Informational Sales Brochure undated.

GreenTech Texas International, "ECODrain and Zugol, The Solution to Urban Storm Water, 'The Largest Source of Water Quality Damage'," Jan. 23, 2000, pp. 1–24. GreenTech Texas International Informational Sales Brochure.

Spill Safe, "Storm Drain Protection!" Spill Safe Informational Sales Brochure undated.

* cited by examiner

SELECTIVE SUSPENSION DRAIN CLOSURE APPARATUS

BACKGROUND OF THE INVENTION

The present invention relates to apparatus and method thereof for handling hazardous materials in general and in particular to a drainage control device for preventing accidental spills of hazardous materials from entering a sewer drain.

Among the most serious problems associated with the handling of hazardous materials is the accidental discharge of such materials into a sewer drain which leads to a sewage treatment plant not equipped to handle such materials, or an accidental discharge of the hazardous material into a storm drain which ultimately flows into a creek, river, lake, bay, or the like. In either case, the cost of containing and cleaning up the material can be enormous both financially and environmentally.

The manufacture of semiconductor products, for example, involves the use of hazardous materials which are usually stored in tanks outside the manufacturing facility. Many times, storm drains and sewer drains are located next to or near the vicinity of these storage tanks. The hazardous material in the tanks is periodically replenished, and removal by waste removal crews creates a risk that, through negligence or by accident, the hazardous material may be spilled onto the ground during the removal or filling of the tanks which could be flow to a nearby storm or sewer drain, resulting in the above-described adverse consequences.

Presently, companies seek to prevent the loss of hazardous materials in a storm drain by covering the drain with an absorbent blanket, such as a SPILL MAT made by Lab Safety Supply of Janesville, Wis., or by surrounding the drain with piles of absorbent material, such as SAFE-T-SORB, available from Orchard Supply Hardware, Sunnyvale, Calif., either before an accidental spill as a preventive measure or afterwards to minimize the damage caused by the spill. Sometimes the edges of the blanket are required to be held down by some sort of heavy object such as, for example, bags of absorbent material.

When the spilled material is a liquid, the use of a bag of absorbent material, or the like, to prevent the liquid material from flowing beneath the edges of the blanket is not always successful. Furthermore, the absorbent blankets which are currently being used for this purpose are expensive and must be replaced as soon as they have become saturated with any liquid, including ordinary rainwater, because, after they are saturated, they no longer will hold any additional liquid.

Also the need to hold down the edges with heavy objects is time consuming and labor intensive. Moreover, when not used to cover a drain, the blanket is usually stored in a pile immediately adjacent to the drain and is therefore unsightly. Alternatively, if the drain is in a traffic area and the blanket can pose an obstacle to traffic. Further, the blanket must be stored some distance from the drain, and thus is likely not to be immediately available for use in case of a spill. When loose material is used to absorb a spill, the material must be cleaned up after a spill or even after a rain. In the interim, the area is unsightly and loose particles of the absorbent material carrying the hazardous material can wash down the drain.

Currently, storm drains modified with catch basins, such as Safe Drain (U.S. Pat. No. 5,383,745 to Shannon) manufactured by Spill Safe® of San Jose, Calif., are being used to prevent hazardous materials from entering the drain in the case of an accidental spill near a sewer drain. However, non-hazardous materials, such as unpolluted water, will be unable to pass onto the sewer drain, because the plunger plugs the catch basin drain hole when hazardous materials are present in the basin. This may lead to the catch basin becoming backed up with the contaminants, thus overflowing into the street. Further, solid objects, such as branches, dirt, slurry, etc., may enter the catch basin and cover the drain hole. This results in the drain hole being obstructed, which could prevent the plunger from automatically plugging the drain hole if a hazardous material is later detected in the catch basin.

U.S. Pat. Nos. 5,528,720, and 5,728,294 to Deming, disclose a drain closure apparatus which can sense hazardous materials entering the storm drain and trigger a disc to rotate and close the entrance to the drain. This closure prevents the hazardous materials from entering the sewer system when hazardous materials are present near the closure apparatus. These inventions utilize a disc which rotates to close the drain hole in response to detecting a hazardous material entering the storm drain. Specifically, the disc rotates by a large threaded rod, which could eventually corrode or wear due to constant contact with liquids entering the drain. Further, these inventions incorporate many exposed moving parts which could be expensive to manufacture and replace.

SUMMARY OF THE INVENTION

In view of the foregoing, it would be advantageous to have a drain closure apparatus which utilizes a minimum number of exposed moving parts and a quick response time, as well as having the ability to allow non-polluted liquid to enter the drain hole while keeping the polluted material separated from the non-polluted material. Further, it would be advantageous to have a drain closure device which has the capability of detecting and measuring pollution levels of the material present near or in the selective suspension device.

Particularly, an apparatus for controlling a flow of a liquid into a sewer drain comprising a catch basin having a catch basin drain coupled with the sewer drain. In addition, a housing element, having a housing chamber, that is positioned within the catch basin, whereby the housing element is coupled with the catch basin drain in a first fluid-tight manner. The housing element having a porous surface positioned below a predetermined level. A column having a proximal end and a distal end, whereby the column is positioned within the housing element and the proximal end is coupled with the catch basin drain in a second fluid tight manner. The distal end is positioned above the predetermined level and an actuator mechanism is coupled with the column and configured to selectively open and close the column to the flow of the liquid that is entering the catch basin drain.

An apparatus for controlling a flow of a liquid into a sewer drain comprising a housing element having an outer surface. The housing element includes at least one aperture on the outer surface, whereby at least some of the liquid enters the housing through the aperture. A conduit is positioned within the housing element, wherein the conduit is coupled with the sewer drain in a fluid tight manner. An actuator mechanism coupled with the conduit, the actuator mechanism further comprising an actuator and a cap coupled to the actuator, The cap is configured to operate between a first position and a second position, wherein the liquid enters the sewer drain when the cap is in the second position.

An apparatus for controlling a flow of a hazardous material into a sewer drain comprising a housing element having a first end and a second end. The housing element is positioned to have the second end coupled with the sewer drain in a first fluid-tight manner. The housing element has at least one aperture located on the first end for allowing the flow to enter the housing element. A conduit positioned is within the housing element, and the conduit is coupled with the sewer drain in a second fluid tight manner, wherein the flow enters the sewer drain through the conduit. An actuator mechanism is coupled with the conduit, and the actuator is configured to selectively allow and prevent the flow from entering the sewer drain. A membrane is coupled with the housing element, wherein the hazardous material flows through the membrane and is screened by the membrane before entering the conduit.

A method for controlling a flow of a liquid into a sewer drain comprising the steps of providing a housing element coupled with the sewer drain in a first fluid-tight manner and having a porous surface positioned below a predetermined level. In addition, providing a column having a proximal end and a distal end, the column being positioned within the housing element, wherein the proximal end is coupled with the sewer drain in a second fluid tight manner and the distal end is positioned above the predetermined level. Also, coupling an actuator mechanism with the column and configuring the actuator mechanism to selectively open and close the column to the flow of the liquid entering the sewer drain.

DETAILED DESCRIPTION OF THE INVENTION

Figure 1:
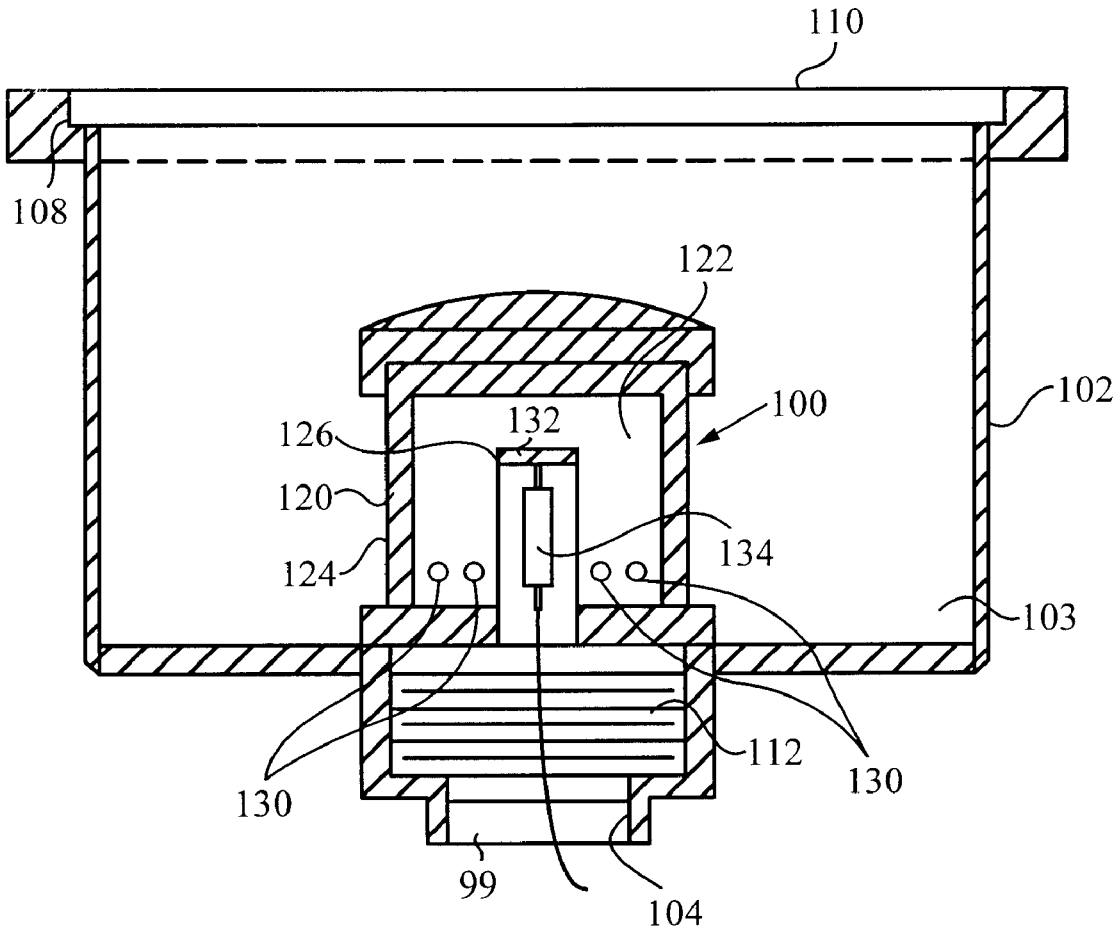
FIG. 1 illustrates a cross section view of the preferred embodiment of the present invention in a catch basin drain.

FIG. 1 illustrates a cross section view of the preferred embodiment of the selective suspension drain closure apparatus. Particularly, FIG. 1 shows the pollution control device 100 positioned inside a catch basin 102 for collecting hazardous materials in the form of liquids, solids or a combination thereof, from entering the sewer 99. The basin 102 utilized in the preferred embodiment is a storm drain container 103 having a catch basin drain or drain hole 104, an annular flange 108 which extends radially outwardly from the top of the container 102 for mating with a corresponding shoulder of the storm drain 106 and a catch basin cover 110 for allowing the flow of liquid into the catch basin 102. Details of the catch basin 102 may be found in U.S. Pat. No. 5,383,745 to Shannon herein incorporated by reference.

The drain hole 104 in the catch basin 102 has conventional pipe threads for threadably receiving a cylindrical adapter 112. A hollow housing 120 having a generally cylindrical shape is connected to the adapter 112. The housing 120 has one or more holes 130 on its outer surface 124 which acts as a pollutant separator. Further, the holes allow liquid to enter the housing chamber 122. Positioned within the housing chamber 122 is a conduit 126 having a cylindrical shape. The conduit 126 is attached and sealed to the bottom end 128 of the housing 120 such that liquid entering the housing chamber 122 must rise to a certain height and enter through the conduit 126 to flow to the sewer drain The conduit 126 has an actuating assembly which comprises a cap 132 connected to an actuator 134 whereby the actuator moves or causes to move the cap 132 between an open and closed position. When the cap 132 is in the open position, liquid reaching a height above the top opening of the conduit 126 enters the conduit 126 and flows to the sewer 99. However, when the cap 132 is in the closed position, the liquid is not allowed to enter the conduit 126 and thus is unable to pass onto the sewer 99. In other words, the pollution control device 100 acts to separate pollutants in the liquid as well seal the storm drain site and prevent hazardous materials from entering the sewer when a hazardous material is present in the catch basin 102 or storm drain. The details of each component of the present invention will be discussed in detail below.

Figure 2:
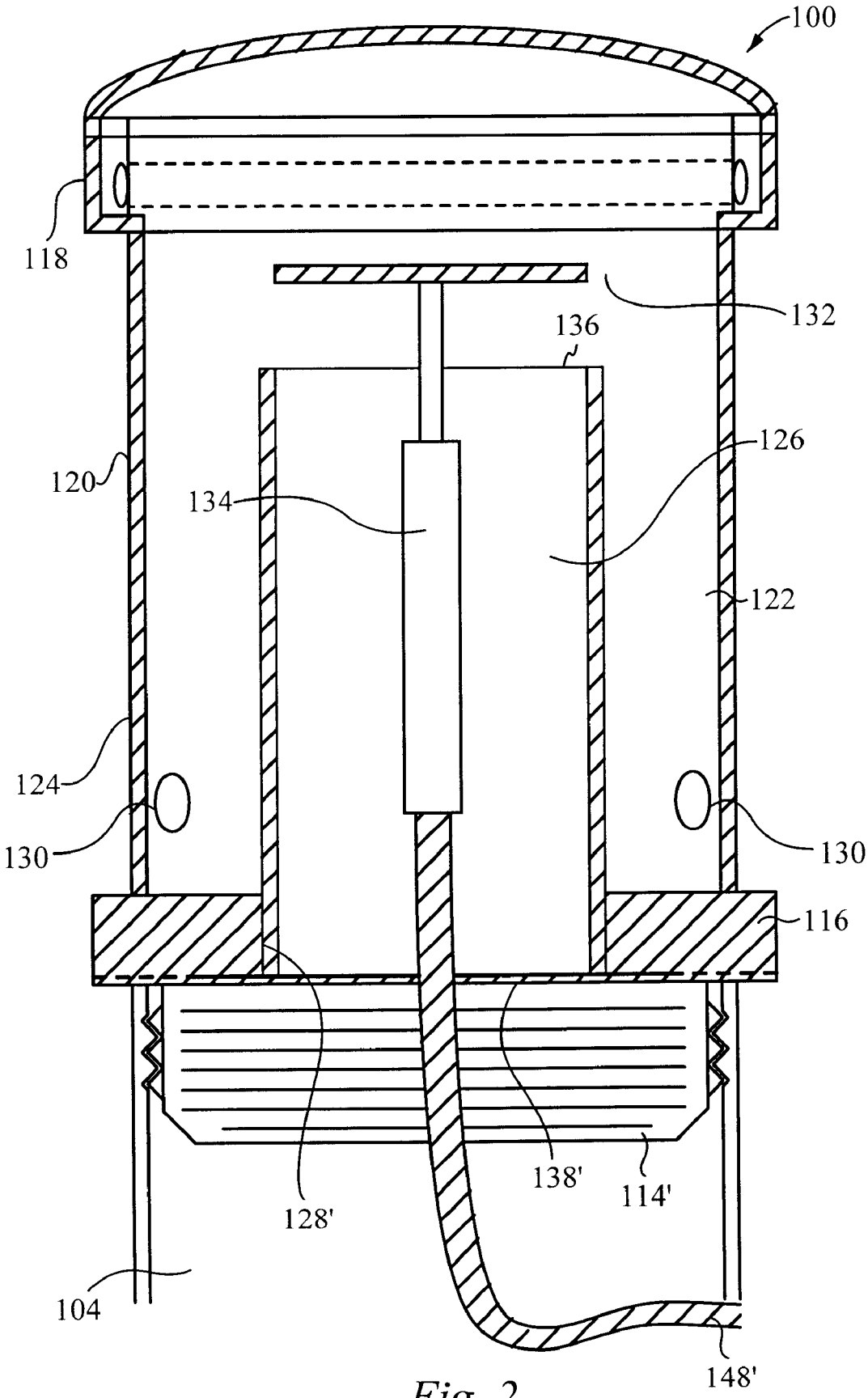
FIG. 2 illustrates a cross sectional view of the preferred embodiment of the selective suspension device in accordance with the present invention.

FIG. 2 illustrates a cross sectional view of the pollution control device 100. In the shown embodiment, the device 100 includes an adapter 112 which has a flanged end 116 and a lower end 114 in which the lower end is threaded to connect the adapter 112 to the drain hole 104 (not shown). The flanged end 116 is shown to have a larger diameter than the lower end 114 because the housing 120, having a larger diameter than the drain hole 104, attaches to the flanged end 116 of the adapter 112. However, the relative diameters of the flanged end 116 and the lower end 114 may vary depending on the size of the drain hole 104. The lower end 114 of the adapter 112, when threaded into the drain hole 104, makes a fluid-tight seal with the inside surface of the drain hole 104, as shown in FIG. 1. This is to prevent any hazardous material from entering the drain hole 104 directly. Therefore, liquid enters the drain hole 104 by passing through the conduit. It should be noted, however, that other means of connecting the adapter 112 to the catch basin drain 104, will suffice as long as the connection is sealed and no fluid can enter between the adapter 112 and the basin drain 104. Some examples of connecting the device 100 to the drain include 104, but are not limited to bolting, gluing, welding, and band-strapping, etc. It is important to note, however, that the device 100 must be removable from the drain 104 to allow the device 100 to be cleaned. Further, it is preferable that the housing 120 and the conduit 126 be freely removable from the adapter to allow a cleaning crew to clean the inside of the housing 120.

Figure 3:
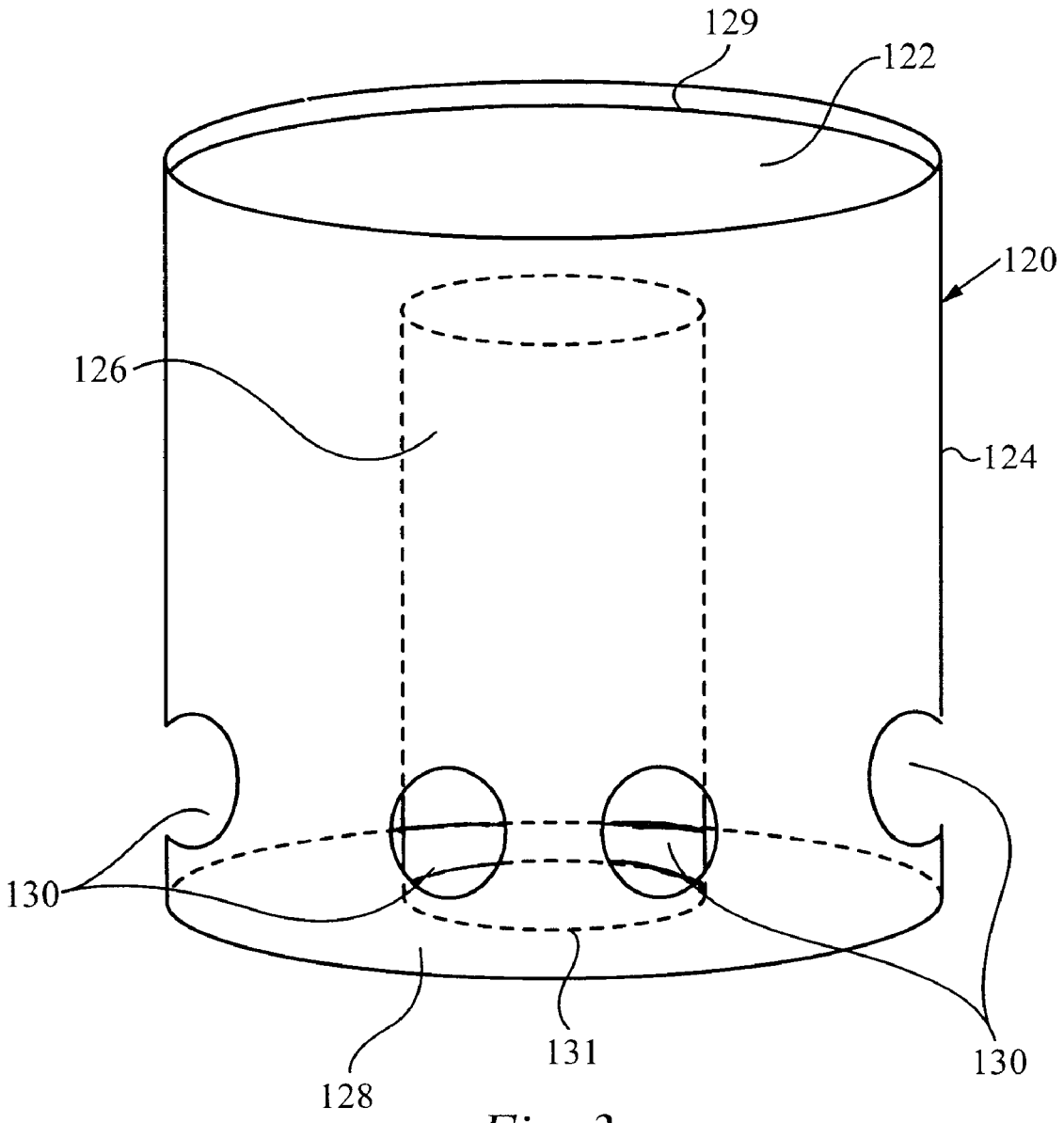
FIG. 3 illustrates a perspective view of the housing element used in accordance with the present invention.

Shown in FIG. 3 is the housing 120, which connects to the adapter 112, and the conduit 126 positioned within the housing 120. The housing 120 is generally cylindrical and is hollow within to define the housing chamber 122. The housing 120 has a first or top end 129 and a second or bottom end 128. The bottom end 128 is partially open and attaches to the flanged end of the adapter (not shown). The top end 129 of the housing 120 is preferably enclosed by attaching a housing lid 118 (FIG. 2) thereto. Alternatively, the housing 120 may be configured to also have its top end 129 exposed for allowing the liquid to enter the housing chamber 129 from the top end 129. The housing lid prevents floating objects and solids from entering the housing chamber 122, which may obstruct the opening to the conduit 126 (shown in FIG. 2). Preferably, the bottom end 128 has an opening 131 of smaller diameter than the outer surface 124 of the housing 120, however this is not required. This configuration provides a sealed connection with the conduit 126, as will be discussed below.

The diameter of the housing 120 can be four, six, eight or ten inches, however the housing diameter is not limited to these sizes. The conduit 126 fits within the housing 120 and is usually one to four inches smaller in diameter than the housing 120. The housing 120 and conduit 126 are preferably made of stainless steel which prevents the outer surface from corroding due to contact with hazardous materials. However, the housing 120 and conduit 126 may be made of any other material that has non-corrosive properties.

The housing 120 has at least one hole or aperture 130 in its outer surface 124 for allowing liquid to enter the housing chamber 122. The size of the holes 130 are large enough to allow the liquid to enter but small enough to keep solids and other slurry materials from entering the housing 120. The holes 130 are positioned along the outer surface 124 at a height below the top of the conduit 126. Preferably, the holes 130 are positioned near the bottom end 128 of the housing 120 such that the liquid quickly rises inside the housing chamber 122 and enters the conduit 126 without flooding the container 103 (FIG. 1).

The configuration of the device 100 serves to separate pollutants in the liquid by natural disassociation. Further, the holes 130 act to prevent pollutants having a lighter density than water from entering the drain 104, because of the height of the conduit 126. In other words, oils and other hazardous materials that naturally float above water will not enter the conduit 126, because water, which is usually denser than most oils, will first enter the housing chamber 122 through the holes 130 near the bottom of the housing 120. The water then rises inside the housing chamber 122 to a height above the top of the conduit 126.

Returning to FIG. 2, the conduit 126 has an actuator assembly within, in which the actuator assembly includes a cap 132 and an actuator 134. The cap 132 provides a sealable interface with the conduit 126 which controls whether the liquid enters the conduit 126 or not. The cap 132 preferably rests on the top can be positioned to fit within the conduit 126 itself by having a diameter slightly smaller than the inside diameter of the conduit 126. Alternatively, the cap 132 may be positioned near the top end 136 of the conduit 126 and attached to a pin to pivot upwards and downwards in a clamp-like manner. In this configuration, the cap 132 would have a diameter larger than the outside diameter of the conduit 126 to ensure a sufficient fit. Nonetheless, the cap 132 may be positioned in any other equivalent configuration to provide a sealable interface. The cap 132 is preferably made of rubber to provide the sealable interface. However, an equivalent substitute such as any impervious material, like plastic etc., will suffice. In the case of using a plastic cap, it is preferred to add a Buna or a Viton-type seal between the cap 132 and the top end 136 of the cap 132.

Figure 4:
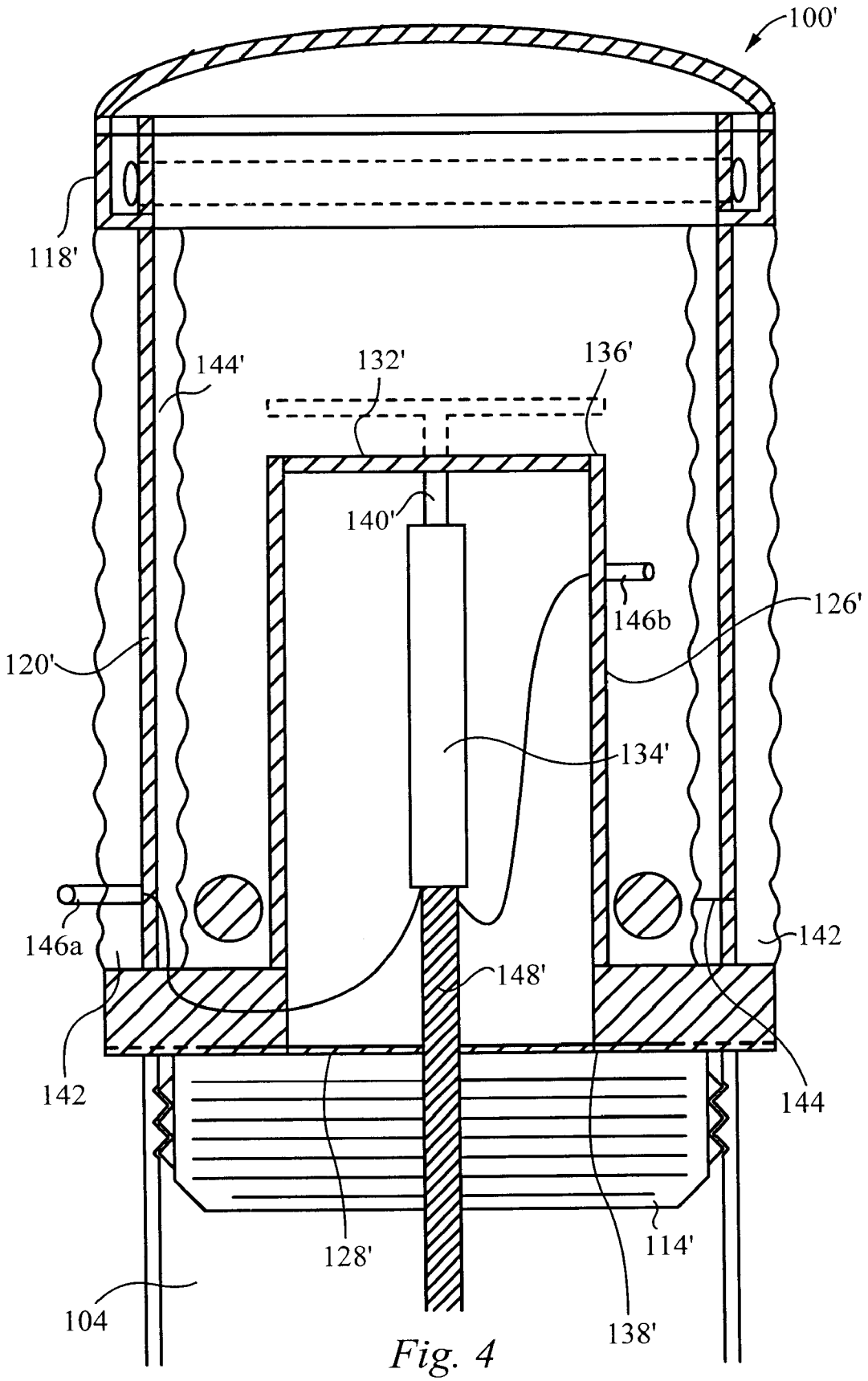
FIG. 4 illustrates a cross sectional view of the selective suspension device with a screening system and sensors attached to the device in accordance with the present invention.

Preferably, the actuator 134 is attached to a mount bar (not shown) within the conduit 126 so that liquid entering the conduit 126 does not move the actuator 134 out of position. The actuator 134 is connected to the cap 132 such that the actuator 134 causes the cap 132 to move between an open position and a closed position. It is preferred that the actuator 134 use pneumatic forces to move the cap 132 between the open and closed position, because of the environmental and economic feasibility of using air. However, FIG. 4 shows the actuator 134 moving the cap 132 by using an extendable rod 140 to sufficiently illustrate the operation of the actuator assembly. Nonetheless, the actuator 134 may move the cap 132 other ways such as an electrical solenoid mechanism, hydraulics, or any other equivalents.

The cap 132 can be biased in an open position in which liquid in the housing chamber 122 at a level above the top end 136 of the conduit 126 enters the conduit 126 and flows to the drain 104. However, it is preferred that the cap 132 be biased in a closed position by a spring, such that liquid is not permitted to flow to the drain 104 until the actuator 134 moves the cap 132 into the open position. In that situation, the actuator 134 would force the cap 132 to the open position to allow liquid to flow to the drain hole 104. The actuator 134 is shown connected to a cable 148 which serves to power as well as activate the actuator 134 by a remote device. The actuator 134 can also be activated automatically by sensors, as will be discussed below.

In preferred operation, liquid enters the storm drain or catch basin. As the catch basin fills, the liquid rises until it reaches the holes 130. Thereafter, the liquid proceeds to enter the device 100 through the holes 130 located in the outer surface 124 of the housing 120. The liquid entering the housing chamber 122 then rises to the height of the top end 136 of the conduit 126. If there are no pollutants detected by the sensors 146*a* and 146*b* in the liquid, the cap 132 will remain in the open position and the liquid will enter the conduit 126 opening and flow out through the drain hole 104 to the sewer 99. However, if pollutants are detected in the liquid, the cap 132 will driven to the closed position and the liquid will not be allowed to pass onto the drain hole 104. At that point, an optional transmitter, which is discussed below, will send a signal alerting the proper authorities that a hazardous material situation is present. The authorities can secure the particular site or sites and initiate clean up of the hazardous materials. Once the site is declared secure, the actuator can be reset to put the cap 132 back into its biased position.

FIG. 4 illustrates a cross sectional view of the pollution control device 100' with a screening system, 142 and 144, and sensors, 146*a* and 146*b*, attached to the device. The adapter 112' connected to the housing 120' with the conduit 126' attached inside the housing 120'. The housing 120' contains a conduit 126' which serves to channel liquid to the drain hole 104'. The conduit 126' is preferably cylindrical and hollow inside, and it has a first or top end 136' and a second or bottom end 138'. The bottom end 138' of the conduit 126' mates with smaller diameter hole in the bottom end 128' of the housing 120'. Thus, the conduit 126' is attached and sealed to the bottom end 128' of the housing 120' to force the water to enter through the top end 136 of the conduit 126' in flowing to the drain 104'.

The membranes in FIG. 4 are positioned to screen or remove substances in the liquid flowing into the housing chamber 122 that enter the drain hole 104 or would damage the sealing surface between the cap 132' and conduit 126'. The membranes are preferably made of reticulated foam, however the membrane can be made of micromesh fiber, micro-fiber, weave, geo-textal fabric, enzyme woven materials, a composite thereof or any commercially viable equivalents. A membrane can be placed anywhere with respect to the device 100'. For instance, an activated charcoal membrane may be placed inside the housing 120 to aid in screening or removing the pollutants from the liquid entering the device so that non-polluted water can flow to the drain hole 104.

In addition, the device 100' in FIG. 4 includes sensors 146 attached to the outer surface 124' of the housing 120' and conduit 126' to sense the level of toxicity in the liquid near the device 100. In FIG. 4, there are two sensors 146*a* and 146*b* shown, however any number of sensors may be utilized. Further, the sensors 146*a* and 146*b* can be positioned anywhere to measure the level of toxicity in the liquid. For instance, a sensor can be placed inside the conduit 126' to alert when a polluted liquid accidentally enters the conduit 126', or a sensor may be placed in an arbitrary location in the catch basin container 103. In addition, the sensors 146*a* and 146*b* may be connected to the actuator 134' to automatically open or close the conduit 126', depending on the circumstances, when the liquid reaches a certain level of toxicity.

For example, in FIG. 4, the outer sensor 146*a* extending from the outer surface 124 measures the toxicity of the liquid entering the housing 120. If the outer sensor 146*a* measures the liquid to have a high level of toxicity, the sensor 146*a* will alert the actuator 134 to close the cap 132, thus closing the conduit 126. The inner sensor 146*b* serves to measure the liquid that has passed through the outer membrane 142 and the inner membrane 144. If the inner sensor 146*b* measures the liquid inside the housing chamber 122 to have an acceptable level of toxicity, it will activate the actuator 134 to lift the cap 132 and thus open the conduit 126.

Figure 5:
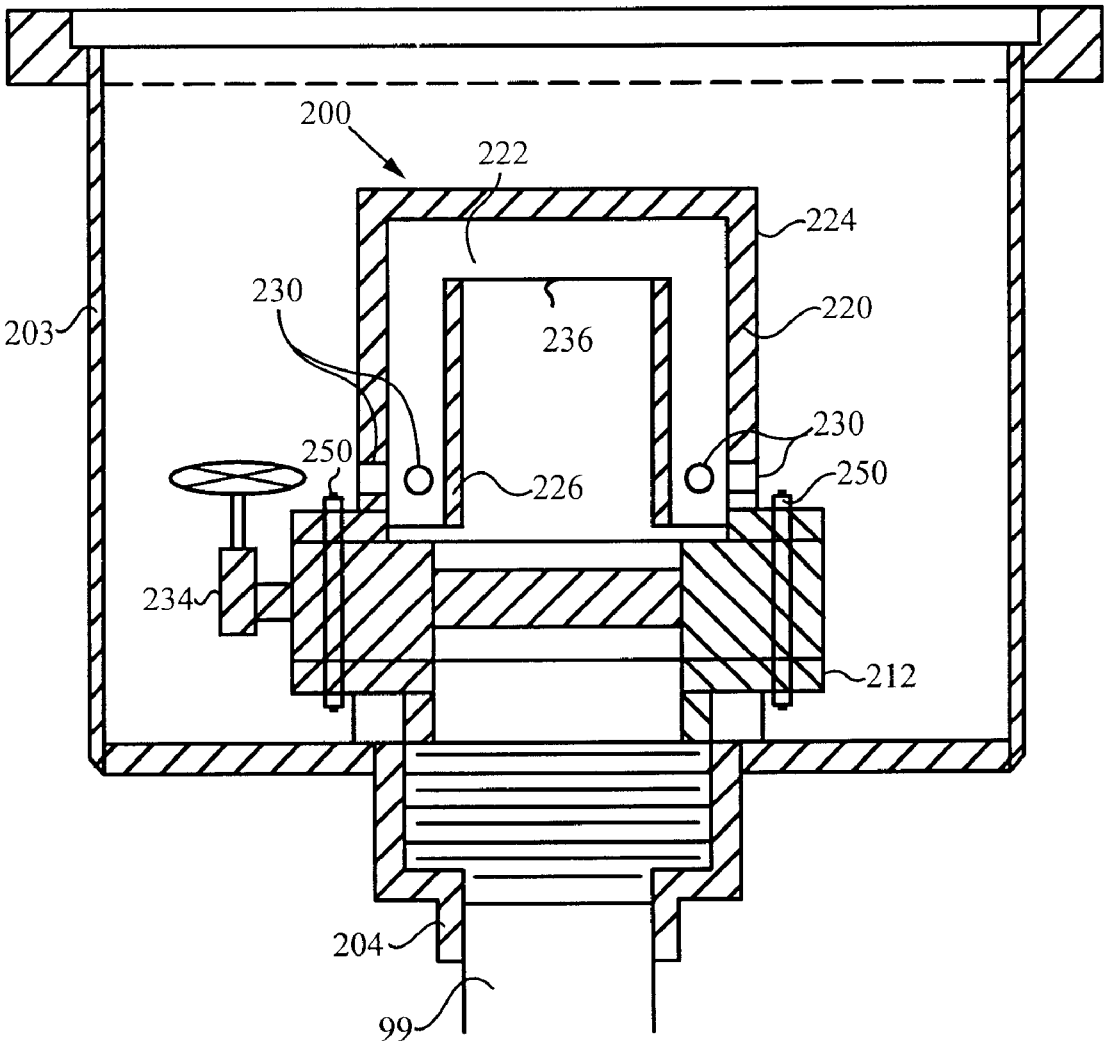
FIG. 5 illustrates an alternative embodiment of a cross sectional view of the selective suspension device in accordance with the present invention.

FIG. 5 illustrates a cross sectional view of another alternative embodiment of the device 200. In FIG. 5, the device 200 is housed within a catch basin 203 having a catch basin drain 204 or drain hole which is coupled to the sewer drain 99. A catch basin adapter 212, as shown, is threaded and screws into the catch basin drain 204. However, the catch basin adapter 212 may be attached by other means such as welding, bolting, etc., as long as the adapter 212 is sealed to the drain 204 and thus prevents liquid from directly entering between the adapter 212 and drain hole 204.

A butterfly valve 234 is connected to the adapter 212 by bolts 250 and serves to control the flow of liquid flowing to the drain 204. The valve 234 is well known in the art and a person skilled in the art may use other valves which serve the same purpose. The device 200 includes the hollow housing 220 attached by bolts 250 to the butterfly valve 234 to make a sealed connection therebetween. The housing 220 has small holes 230 near the bottom of its outer surface 224 to allow the liquid to enter the housing chamber 222, defined as the inside of the housing 220.

The device has a conduit 226 positioned within the chamber 222 and sealed to force liquid entering the housing chamber 222 to rise within the chamber 222 and enter the top end 236 of the conduit 226. In this embodiment, the conduit 226 does not have a cap nor actuator assembly, but instead utilizes a butterfly valve 234 or other existing valves to control the flow of liquid flowing to the drain 204.

In operation, liquid enters the storm drain or catch basin 203. As the catch basin fills, the liquid rises until it reaches the holes 230. Thereafter, the liquid proceeds to enter the device 200 through the holes 230. The liquid entering the housing chamber 222 then rises to the height of the top end 236 of the conduit 226. The liquid then enters the conduit 226 flows down the conduit through butterfly valve 234 and the drain hole 204 to the sewer 99. Sensors and membranes may also be used in with the device 200, described above.

Figure 6:
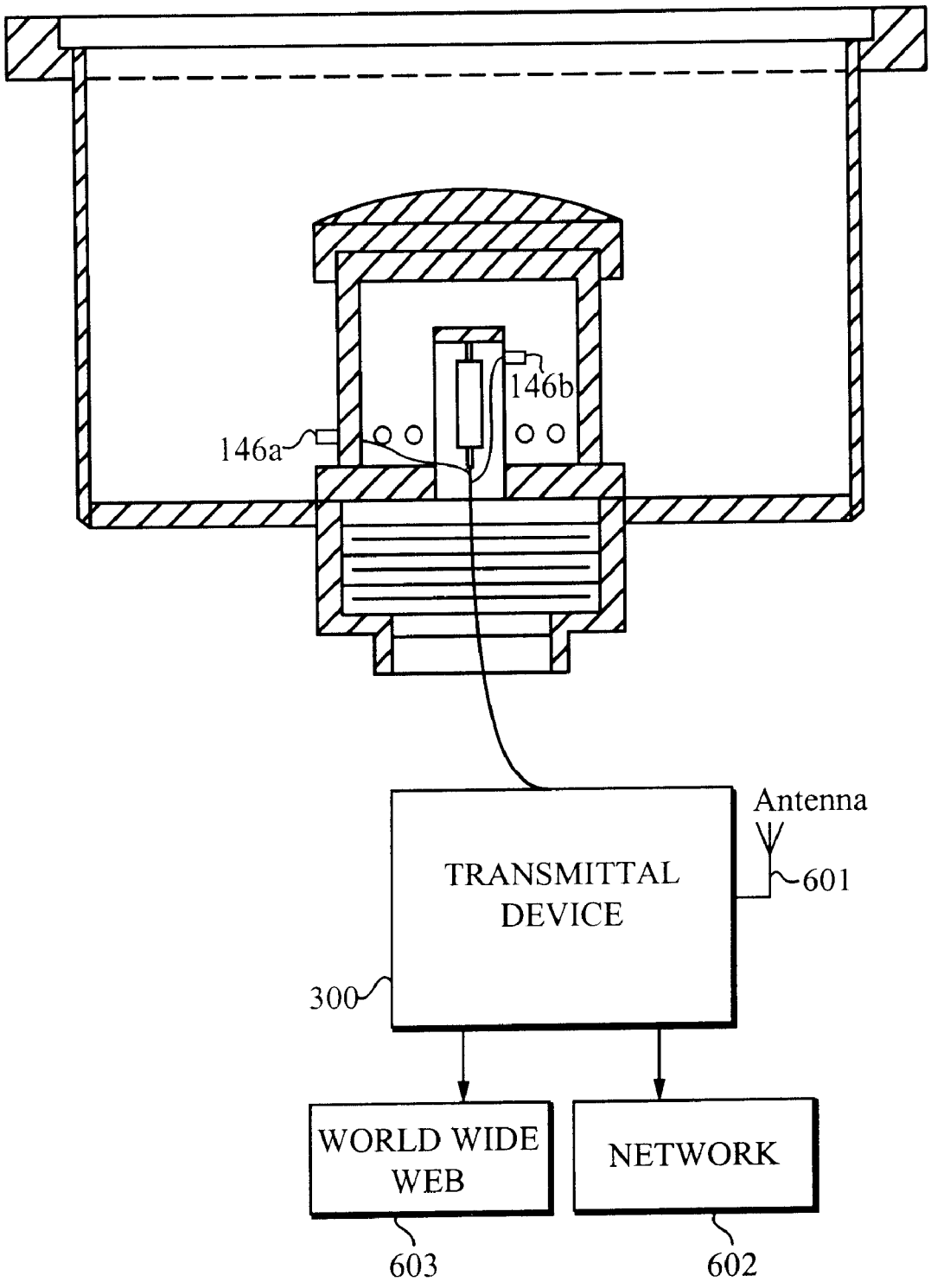
FIG. 6 illustrates an alternative embodiment of a cross sectional view of the selective suspension device with a transmitting device coupled therewith in accordance with the present invention.

FIG. 6 illustrates the present invention incorporated with a transmitting device 300 having a variety of applications, from alerting authorities of the presence of hazardous materials to recording and transmitting pollution control data to governmental agencies. The transmitting device 300 shown in FIG. 6 can be coupled with the actuator assembly in the preferred embodiment or sensors located in the catch basin. It must be noted that although the transmitting device 300 is described with the device 100' in the present invention, the transmitting device 300 may be used in any existing storm drain or catch basin configuration.

The transmitting device 300 is shown in FIG. 6 in conjunction with the selective suspension unit device 100' and is coupled to the actuator 134 and the sensors 146*a* and 146*b*. The transmitting device 300 receives the information from the actuator 134 and sensors 146*a* and 146*b* and processes the data to be suitable for transmission. The data received from the device 100 can include information pertaining to the status of the device 100 itself as well as the contents of the materials in the catch basin.

For instance, the sensors 146*a* and 146*b* can detect and send data to the transmitting device 300 including, but not limited to, the contents of the liquid; the rate of flow of the liquid; the amount of liquid present, etc. Specifically, the data received by the transmitting device 300 may contain information concerning the number of pollutants sensed in the water as well as their relative percentages. Further, the data may contain information relating to how fast the polluted liquid is entering the catch basin 102 as well as how much polluted liquid is present in the catch basin 102. This information would serve to alert the proper authorities or clean-up crews as to the level of priority in reaching the site so that the more dangerous sites may be attended to first.

In addition, the actuator 134 may relay information to the transmitting device 300 as to whether the actuator 134 is in the open position or closed position. Further, a sensor (not shown) may be placed inside the conduit 134 which relays information relating to the amount of flow passing through the conduit 134 as well as the contents of the liquid flowing through the conduit 134. It must be noted that the data received by the transmitting device 300 may relate to other information not stated herein and is therefore not limited to what is described above.

The transmitting device 300 receives and processes the data from the device 100 and can transmit the data in a variety of ways. For instance, FIG. 6 illustrates that the transmitting device 300 may relay the data by wireless communication via an antenna 601, by network 602, by the World Wide Web 603, or any other means. The data is transmitted to a receiving station or end which processes the information. For instance, the transmitting device 300 can transmit data to a cellular device or laptop utilized by the clean up crews or to a central dispatcher which communicates with the clean up crews or municipal authorities.

Moreover, the receiving end can utilize a database containing each storm drain location and which industries or companies are present near each storm drain location. Thus, the dispatcher or crew can view the data and determine exactly which storm drain location is declaring an alert as well as which company or industry is discharging the hazardous material. From this information, the dispatcher or crew can then notify the company discharging the hazardous material and alert them of the emergency.

Further, the crew or dispatcher can view the data transmitted from the transmitting device 300 and determine what types of pollutants are entering the storm drain. From this information, the crew will know which clean up tools will be needed and which safety procedures have to be executed. Further, the crew will be able to ascertain how quickly the liquid is entering the drain and when the drain will begin to overflow. This information will assist the crew to call in additional support to help in the clean up or notify municipal authorities to declare an emergency. The transmitting device 300 can also be connected to a closed network 602 which is monitored by the central dispatcher or emergency services.

In another application, the transmitting device 300 may serve as an integral part of developing a Total Maximum Daily Load (TMDL), which serves to set limits on the amount of pollutants entering a certain body of water. Many states and counties are required to set TMDL's for their watershed. The TMDL is a calculation of the maximum amount of a pollutant that a body of water can receive and still meet water quality standards. This maximum amount is then allocated to a pollutant's source. A TMDL involves estimating the pollutant loads for the areas; identifying the land uses to which pollutant reduction factors are to be applied; and determining the best management practice (BMP) based on the relative comparison of different sets of BMP factors. BMP's are defined as good housing keeping practices, e.g. sweeping, operational procedure modification and the like, as well as structural controls.

For many years these tasks have been performed manually. The transmitting device 300 used with the present invention or any existing storm drains presents important new opportunities for pollutant load analysis and control as well as selecting the appropriate BMP. The transmitting device 300 in conjunction with sensors inside the storm drain can generate quantitative data, such as rainfall and pollutant load characteristics, which makes the report generation for the analysis on the BMPs extremely fast. Further, the transmitting device 300 can separate the quantitative data into geographical regions to help municipalities determine where levels of pollution are higher or lower as well as how much pollution a company may be discharging into nearby storm drains.

Specifically, sensors positioned within the storm drain can monitor the pollutant load characteristics in the water as the water passes on through the drain. The sensors then pass this information to the transmitting device 300 which sends the data through a network 602 for interested federal, state and municipal agencies. This information could also be available for the public via the World Wide Web 603.

For example, an environmental agency which belongs to the network 602 or has access to the Internet 603 (if the information is publicly available) will receive data from each of the city's storm drains utilizing the transmitting device 300. The data preferably will identify the storm drain, give the storm drain's location as well as the closest nearby companies that discharge water and other liquids into the respective storm drain. The data will also give the amount of rainfall over a period of time (hours, days, weeks, months, etc), the total amount of pollutant detected by the sensors, a breakdown of which pollutants were detected and amount of each pollutant by volume and percentage. Other relevant information can be compiled and transmitted, such as: the amount of contaminants produced from nearby companies and industry; identity of contaminants produced by each nearby company or industry that have detected in the storm drain, and the number of times the valve 234 or the cap 132 has been closed due to presence of pollutants.

Further, the transmitting device 300 could be used for environmental consultants to help companies meet environmental best management practices and pollution control guidelines by evaluating the performance of their housekeeping practices, e.g. sweeping, operational procedure modification and the like. For example, the transmitting device 300 can be incorporated with the embodiment shown in FIG. 4. Here, membranes 142 and 144 are incorporated with the device 100' and sensors 146*a* and 146*b* are placed on the outside membrane 142 and inside membrane 144, respectively. The sensors can generate data showing the effectiveness of the membranes that are being used with the device 100' as well as other devices upstream. Specifically, the outer sensor 146*a* would measure the amount of pollutant present in the liquid entering the housing 120' and the inside sensor 146*b* would measure the amount of pollutant present in the liquid inside the housing chamber 122'. The transmitting device 300 would then send this information along with the amount of liquid inside the chamber 122' and the flow rate of the liquid as well as other relevant information to an environmental consultant for analysis. From the data, the consultant would then be able to determine how effective the membranes are and whether other types of membranes would be more preferable in helping the company reach its BMP goal.

Moreover, information generated and transmitted by the transmitting device 300 may facilitate federal and state agencies in granting "points" to companies for their respective share of pollution control. For instance, a state or local environmental agency can monitor the storm drains near a company that the agency is auditing and receive the quantitative data from the transmitting devices 300 from those drains via the network 602 or the Internet 603. From this data, the agency will have the necessary information relating to the amount of pollutants discharged by the company. Thus, the agency can then determine from the data whether the amount of pollutants discharged by the company is above or below the amount of pollution discharge allotted to that company. In other words, this information would facilitate the agency in apportioning the amount of points granted to the company as well as provide the agency with continuous monitoring capabilities for each company it audits.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications may be made in the embodiment chosen for illustration without departing from the spirit and scope of the invention.

What is claimed is:

1. An apparatus for controlling a flow of a liquid into a sewer drain comprising:

a. a catch basin having a catch basin drain coupled with the sewer drain;

b. a housing element positioned within the catch basin, the housing element coupled with the catch basin drain in a first fluid-tight manner and having a porous surface positioned below a predetermined level;

c. a column having a proximal end and a distal end, the column positioned within the housing element, wherein the proximal end is coupled with the catch basin drain in a second fluid tight manner and the distal end is positioned above the predetermined level; and d. an actuator mechanism coupled with the column and configured to selectively open and close the column to the flow of the liquid entering the catch basin drain.

2. The apparatus in claim 1 further comprising a membrane coupled with the housing element, wherein the liquid passes through the membrane before entering the conduit.

3. The apparatus in claim 2 wherein the membrane is made of a reticulated foam material.

4. The apparatus in claim 2 wherein the membrane is positioned around an outer surface of the housing element.

5. The apparatus in claim 2 wherein the membrane is positioned within the housing element.

6. The apparatus in claim 1 wherein the actuator mechanism further comprises:

a. a cap coupled to the distal end of the column, the cap having a first position and a second position, wherein the cap is biased to be in the first position; and b. an actuator coupled with the cap, wherein the actuator induces the cap to move from the first position to the second position.

7. The apparatus in claim 1 further comprising at least one sensor for sensing a level of toxicity in the liquid entering the apparatus, wherein the sensor activates the actuator mechanism when the level of toxicity reaches a predetermined value.

8. The apparatus in claim 1 wherein the actuator mechanism is activated by a remote device.

9. An apparatus for controlling a flow of a liquid into a sewer drain comprising:

a. a housing element having an outer surface, the housing element including at least one aperture on the outer surface, wherein at least some of the liquid enters the housing element through the aperture;

b. a conduit positioned within the housing element, wherein the conduit is coupled with the sewer drain in a fluid tight manner; and c. an actuator mechanism coupled with the conduit, the actuator mechanism further comprising:

i. an actuator; and ii. a cap coupled to the actuator, the cap configured to operate between a first position and a second position, wherein the liquid enters the sewer drain when the cap is in the second position.

10. The apparatus in claim 9 further comprising a membrane coupled with the housing element, wherein the liquid passes through the membrane before entering the conduit.

11. The apparatus in claim 10 wherein the membrane is positioned around the outer surface of the housing element.

12. The apparatus in claim 10 wherein the membrane is positioned within the housing element.

13. The apparatus in claim 10 wherein the membrane is made of a reticulated foam material.

14. The apparatus in claim 9 further comprising at least one sensor for sensing a level of toxicity in the liquid entering the apparatus, wherein the sensor activates the actuator mechanism when the level of toxicity reaches a predetermined value.

15. An apparatus for controlling a flow of a liquid into a sewer drain comprising:

a. a housing element having a chamber and at least one aperture positioned at a predetermined height on an outer surface of the housing element for allowing the liquid to enter the chamber;

b. a conduit having an opening configured to permit the liquid entering the chamber, the conduit coupled with the sewer drain in a fluid tight manner, wherein the flow passes to the sewer drain through the conduit; and c. an actuator mechanism coupled with the conduit, the actuator mechanism configured to selectively control the liquid from entering the sewer drain.

16. The apparatus in claim 15 wherein the conduit is positioned within the chamber and having the opening positioned above the predetermined height.

17. The apparatus in claim 15 further comprising at least one sensor for sensing a level of toxicity in the liquid entering the apparatus, wherein the sensor activates the actuator mechanism when the level of toxicity reaches a predetermined value.

18. The apparatus in claim 15 further comprising a membrane coupled with the apparatus.

19. The apparatus in claim 15 wherein the actuator mechanism further comprises:

a. a cap coupled to a distal end of the conduit, the cap having a first position and a second position, wherein the cap is biased to be in the first position; and b. an actuator coupled with the cap, wherein the actuator induces the cap to move from the first position to the second position.

20. The apparatus in claim 15 wherein the actuator mechanism further comprises a butterfly valve.

21. An apparatus for controlling a flow of a hazardous material into a sewer drain comprising:

a. a housing element having a first end and a second end, the housing element positioned to have the second end coupled with the sewer drain in a first fluid-tight manner, the housing element having at least one aperture for allowing the flow to enter the housing element;

b. a conduit positioned within the housing element, the conduit coupled with the sewer drain in a second fluid tight manner, wherein the flow enters the sewer drain through the conduit;

c. an actuator mechanism coupled with the conduit, the actuator configured to selectively allow and prevent the flow from entering the sewer drain; and d. a membrane coupled with the housing element, wherein the hazardous material flows through the membrane before entering the sewer drain.

22. The apparatus in claim 21 wherein the membrane is positioned around an outer surface of the housing element.

23. The apparatus in claim 21 wherein the membrane is positioned within the housing element.

24. The apparatus in claim 21 further comprising at least one sensor for sensing a level of toxicity in the hazardous material entering the apparatus, wherein the sensor activates the actuator mechanism when the level of toxicity reaches a predetermined value.

25. The apparatus in claim 21 wherein the membrane is made of a reticulated foam material.

26. A method for controlling a flow of a liquid into a sewer drain comprising the steps of:

a. providing a housing element coupled with the sewer drain in a first fluid-tight manner and having a porous surface positioned below a predetermined level;

b. providing a column having a proximal end and a distal end, the column positioned within the housing element, wherein the proximal end is coupled with the sewer drain in a second fluid tight manner and the distal end is positioned above the predetermined level;

c. coupling an actuator mechanism with the column; and d. configuring the actuator mechanism to selectively open and close the column to the flow of the liquid entering the sewer drain.

27. The method as claimed in 26 further comprising the step of screening the flow of the liquid before the liquid enters the sewer drain.

* * * * *

UNITED STATES PATENT AND TRADEMARK OFFICE

CERTIFICATE OF CORRECTION

PATENT NO. : 6,558,077 B1
DATED : May 6, 2003
INVENTOR(S) : Cameron M. Colson

It is certified that error appears in the above-identified patent and that said Letters Patent is hereby corrected as shown below:

Title page, Item [54], Column l, lines 1 thru 3,
Please insert -- AND METHOD OF CONTROLLING FLOW OF LIQUID -- after "SELECTIVE SUSPENSION DRAIN CLOSURE APPARATUS".

Item [56], References Cited, OTHER PUBLICATIONS, in the reference "Remedial Solutions, Inc.," please replace "www.remedial.solutions.com/aqua-shield/cf-200-specs.html" with -- www.remedial.solutions.com/aqua_shield/cf-200-specs.html --.
In the reference "Storm King Dynamic Separator", please delete "." after "undated."

Signed and Sealed this

Ninth Day of September, 2003

JAMES E. ROGAN
*Director of the United States Patent and Trademark Office*